US010428466B2

(12) United States Patent
Higuchi

(10) Patent No.: US 10,428,466 B2
(45) Date of Patent: Oct. 1, 2019

(54) SHEET MANUFACTURING APPARATUS AND SHEET MANUFACTURING METHOD

(71) Applicant: SEIKO EPSON CORPORATION, Tokyo (JP)

(72) Inventor: Naotaka Higuchi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 15/561,377

(22) PCT Filed: Apr. 5, 2016

(86) PCT No.: PCT/JP2016/001919
§ 371 (c)(1),
(2) Date: Sep. 25, 2017

(87) PCT Pub. No.: WO2016/163118
PCT Pub. Date: Oct. 13, 2016

(65) Prior Publication Data

US 2018/0080176 A1 Mar. 22, 2018

(30) Foreign Application Priority Data

Apr. 6, 2015 (JP) ..... 2015-077462

(51) Int. Cl.
*D21H 27/02* (2006.01)
*B27N 3/04* (2006.01)
(Continued)

(52) U.S. Cl.
CPC ..... *D21H 27/02* (2013.01); *B27N 3/04* (2013.01); *D21F 9/00* (2013.01); *D21F 13/00* (2013.01);
(Continued)

(58) Field of Classification Search
CPC . D04H 1/732; D04H 1/60; D04H 1/26; B27N 3/04; B27N 1/02; D21B 1/06;
(Continued)

(56) References Cited

U.S. PATENT DOCUMENTS 9,309,622 B2 * 4/2016 Higuchi ..... D21B 1/06
9,428,862 B2 * 8/2016 Higuchi ..... D21F 9/04
(Continued)

FOREIGN PATENT DOCUMENTS

EP 2784210 A1 10/2014
FR 2786510 A1 6/2000
(Continued)

OTHER PUBLICATIONS

Machine Translation of WO 00/32874 (Year: 2000).*
The Extended European Search Report for the corresponding European Patent Application No. 16776290.5 dated Nov. 13, 2018.

*Primary Examiner* — Jose A Fortuna

(57) ABSTRACT

A sheet manufacturing apparatus having: a defibrating unit configured to defibrate, in air, feedstock containing fiber; a mixing unit configured to mix, in air, resin with the fiber defibrated from the feedstock by the defibrating unit; an air-laying unit configured to lay a web from the mixture output from the mixing unit; a liquid application unit configured to add water to part of the web laid by the air-laying unit; and a sheet forming unit configured to form a sheet with parts having different light transmittance by heating and compressing the web to which water was added by the liquid application unit.

7 Claims, 3 Drawing Sheets

(51) Int. Cl.

| | |
|---|---|
| ***D21F 13/00*** | (2006.01) |
| ***D21H 17/33*** | (2006.01) |
| ***D21H 21/06*** | (2006.01) |
| ***D21F 9/00*** | (2006.01) |
| ***D21G 1/00*** | (2006.01) |

(52) U.S. Cl.
CPC ..... *D21G 1/00* (2013.01); *D21H 17/33* (2013.01); *D21H 21/06* (2013.01)

(58) Field of Classification Search
CPC ..... D21B 1/028; D21F 9/00; D21F 13/00; D21G 1/00; D21H 21/06; D21H 27/02; D21H 17/33
See application file for complete search history.

(56) References Cited

U.S. PATENT DOCUMENTS

| | | | | |
|---|---|---|---|---|
| 9,476,161 | B2 * | 10/2016 | Higuchi | D21F 9/04 |
| 9,540,768 | B2 * | 1/2017 | Higuchi | D21F 1/526 |
| 9,771,685 | B2 * | 9/2017 | Omagari | D04H 1/00 |
| 9,776,365 | B2 * | 10/2017 | Higuchi | B29C 43/34 |
| 2010/0295291 | A1 | 11/2010 | Rancien et al. | |
| 2014/0290887 | A1 * | 10/2014 | Gomi | D21B 1/063 162/252 |
| 2014/0290888 | A1 * | 10/2014 | Gomi | D21D 5/24 162/254 |
| 2014/0290889 | A1 * | 10/2014 | Oguchi | B07B 1/00 162/259 |
| 2014/0290890 | A1 * | 10/2014 | Seki | D21F 9/00 162/261 |
| 2016/0332325 | A1 * | 11/2016 | Murayama | B27N 1/02 |
| 2018/0021976 | A1 * | 1/2018 | Nakamura | B27N 3/04 264/115 |
| 2018/0080176 | A1 * | 3/2018 | Higuchi | B27N 3/04 |
| 2018/0237992 | A1 * | 8/2018 | Nagai | D04H 1/54 |
| 2018/0251926 | A1 * | 9/2018 | Higuchi | D04H 1/732 |
| 2018/0257258 | A1 * | 9/2018 | Higuchi | B27N 3/04 |
| 2018/0347086 | A1 * | 12/2018 | Higuchi | D04H 1/732 |
| 2019/0030750 | A1 * | 1/2019 | Miyasaka | B27N 3/007 |
| 2019/0032280 | A1 * | 1/2019 | Miyasaka | D21G 9/0009 |

FOREIGN PATENT DOCUMENTS

| | | | | |
|---|---|---|---|---|
| JP | 06-228900 | A | 8/1994 | |
| JP | 2002-144305 | A | 5/2002 | |
| JP | 2011-500974 | A | 1/2011 | |
| JP | 2014-208924 | A | 11/2014 | |
| JP | 2014-208925 | A | 11/2014 | |
| WO | 00/32874 | A1 | 6/2000 | |
| WO | WO-0032874 | A1 * | 6/2000 | B41M 3/10 |

* cited by examiner

SHEET MANUFACTURING APPARATUS AND SHEET MANUFACTURING METHOD

TECHNICAL FIELD

The present invention relates to a sheet manufacturing apparatus and a sheet manufacturing method.

BACKGROUND

Forming sheets or films by depositing fibrous materials in thin layers and creating bonds between the layered fibers is a known process. This process is typically used to make paper in a slurry (screening) method using water. Paper made in a slurry method typically has intertwined cellulose fibers derived from wood, for example, held together in part by a binder (a strengthening agent (starch glue, water-based resin)).

However, because the slurry method is a wet method, it requires a large amount of water, requires dewatering and drying after the paper is formed, and therefore requires a large amount of energy and time. The water must then be appropriately processed as waste water. Meeting the growing desire for reduced energy consumption and environmental protection has therefore become increasingly difficult. Equipment used in the slurry method also requires large-scale utilities to meet the water, electricity, and waste water treatment needs, and reducing the size of the equipment is difficult. Methods that require little to no water, referred to as dry methods, are therefore desired as an alternative to making paper by the slurry method.

PTL 1 describes recovered paper board obtained by layering a resin-impregnated sheet on a layered form acquired by dry defibration of recovered paper and mixing adhesive with the defibrated fibers, and then applying heat and pressure.

CITATION LIST

Patent Literature

[PTL 1] JP-A-2002-144305

SUMMARY OF INVENTION

Technical Problem

A watermark may be formed on paper and other types of sheet media. Generally, a watermark is made using a cylinder mould or dandy roll during the paper-making process. Because the watermark is made using a mould or roll, these processes are often used when making the same watermark on a large volume of paper.

Changing the design of the watermark requires changing the mould or the roll. As a result, changing the design of the watermark requires making and changing the mould or roll, which increases labor and cost. The configuration and processes required to impart a watermark on paper are the same whether the paper is made using a slurry method or the paper is made using a dry method such as described in PTL 1.

An objective of some embodiments of the invention is to provide a sheet manufacturing apparatus and a sheet manufacturing method enabling making a watermark of a desired design on a sheet, and enabling easily changing the design of the watermark.

Solution to Problem

The present invention is directed to solving at least part of the foregoing problem, and can be achieved by the embodiments or examples described below.

A sheet manufacturing apparatus according to one aspect of the invention includes: a defibrating unit configured to defibrate, in air, feedstock containing fiber; a mixing unit configured to mix, in air, resin with the fiber defibrated from the feedstock by the defibrating unit; an air-laying unit configured to lay a web from the mixture output from the mixing unit; a liquid application unit configured to add water to part of the web laid by the air-laying unit; and a sheet forming unit configured to form a sheet with parts having different light transmittance by heating and compressing the web to which water was added by the liquid application unit.

A sheet manufacturing apparatus according to this aspect of the invention can form a watermark in the part where water is added by simply imparting water and then applying heat and pressure. As a result, watermarks of any design can be formed, and the design of the watermark can be easily changed.

The sheet manufacturing apparatus of the invention may also have a pressuring unit that compresses the web; the liquid application unit adding the water to the web after compression by the pressuring unit.

The sheet manufacturing apparatus according to this aspect of the invention adds water after compressing the laid web, thereby suppressing bleeding in the area where water is added. As a result, the watermark formed where water is added can be more sharply defined.

A sheet manufacturing apparatus according to another aspect of the invention has a defibrating unit configured to defibrate, in air, feedstock containing fiber; a mixing unit configured to mix, in air, resin with the fiber defibrated from the feedstock by the defibrating unit; an air-laying unit configured to lay a web from the mixture output from the mixing unit; a sheet forming unit configured to form a first sheet by heating the web laid by the air-laying unit; a liquid application unit configured to add water to part of the first sheet; and a heating/compression unit configured to heat and compress the first sheet to which water was imparted by the liquid application unit, forming a second sheet with parts having different light transmittance.

A sheet manufacturing apparatus according to this aspect of the invention can form a watermark by simply applying heat and pressure to the first sheet after adding water to the first sheet. As a result, watermarks of any design can be formed in the second sheet, and the design of the watermark can be easily changed.

In a sheet manufacturing apparatus of the invention according to another aspect of the invention, the liquid application unit imparts water by an inkjet method.

The sheet manufacturing apparatus thus comprised can form detailed watermarks with high precision.

In a sheet manufacturing apparatus of the invention according to another aspect of the invention, the liquid application unit imparts water containing nanofiber.

The sheet manufacturing apparatus thus comprised can strengthen, by means of nanofiber, the hydrogen bonds between fibers contained in the web and the first sheet. This enables forming even more clearly defined watermarks because the area to which water is added has higher density and greater transmittance of light.

Another aspect of the invention is a sheet manufacturing method including: a defibrating step of defibrating, in air, feedstock containing fiber; a mixing step of mixing, in air, resin with the fiber defibrated from the feedstock in the defibrating step; an air-laying step of laying a web from the mixture output by the mixing step; a liquid application step of adding water to part of the web laid in the air-laying step; and a sheet forming step of forming a sheet with parts having parts with different light transmittance by heating and compressing the web to which water was added in the liquid application step.

A sheet manufacturing method according to this aspect of the invention can form a watermark in the part to which water is added by simply imparting water and then applying heat and pressure. As a result, sheets in which watermarks of any desired design can be formed can be easily manufactured, and the sheets can be easily manufactured even if the design of the watermark changes.

Another aspect of the invention is a sheet manufacturing method including: a defibrating step of defibrating, in air, feedstock containing fiber; a mixing step of mixing, in air, resin with the fiber defibrated from the feedstock in the defibrating step; an air-laying step of laying a web from the mixture output by the mixing step; a sheet forming step of forming a first sheet by heating the web laid in the air-laying step; a liquid application step of adding water to part of the first sheet; and a heating/compression step of heating and compressing the first sheet to which water was imparted in the liquid application step, forming a second sheet having parts with different light transmittance.

A sheet manufacturing method according to this aspect of the invention can form a watermark by simply heating and compressing a first sheet to which water has been applied. As a result, second sheets can be easily manufactured with watermarks of any desired design, and second sheets can be easily manufactured even if the design of the watermark changes.

DESCRIPTION OF EMBODIMENTS

Preferred embodiments of the invention are described below. The embodiments described below describe exemplary embodiments of the invention. The invention is not limited to the following examples, and includes variations thereof not departing from the scope of the accompanying claims. Note that embodiments of the invention do not necessarily require all configurations described below.

A sheet manufacturing apparatus according to this embodiment has a defibrating unit that defibrates, in air, feedstock including fiber; a mixing unit that mixes, in air, resin with the defibrated feedstock that was defibrated by the defibrating unit; an air-laying unit that lays the mixture output by the mixing unit; a liquid application unit that adds water by an inkjet method, for example, to part of the precipitate laid by the air-laying unit; and applies pressure and heat to the air-laid precipitate, to which water was applied by the liquid application unit, to form sheets having parts with different light transmittance.

1. Sheet Manufacturing Apparatus

1.1. Configuration

Figure 1:
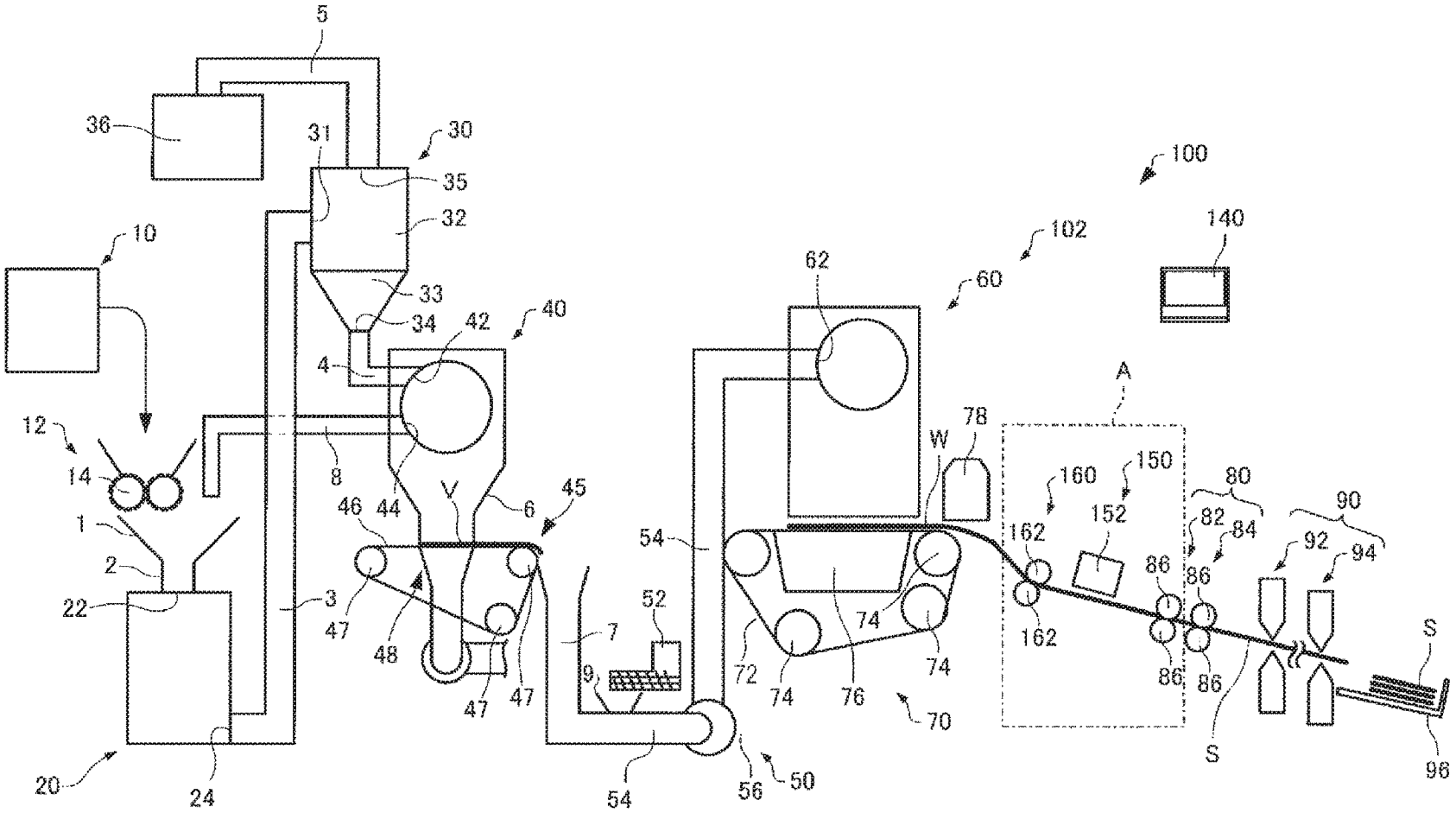
FIG. 1 illustrates a sheet manufacturing apparatus according to an embodiment of the invention.

A sheet manufacturing apparatus according to this embodiment is described below with reference to the accompanying figures. FIG. 1 schematically illustrates a sheet manufacturing apparatus 100 according to this embodiment.

As shown in FIG. 1, the sheet manufacturing apparatus 100 has a supply unit 10, manufacturing unit 102, and control unit 140. The manufacturing unit 102 manufactures sheets. The manufacturing unit 102 includes a shredder 12, defibrating unit 20, classifier 30, separator 40, first web forming unit 45, mixing unit 50, air-laying unit 60, second web forming unit 70, sheet forming unit 80, and cutting unit 90.

The supply unit 10 supplies feedstock to the shredder 12. The supply unit 10 is, for example, an automatic loader for continuously supplying feedstock material to the shredder 12. The feedstock supplied by the supply unit 10 includes fiber from recovered paper or pulp sheets, for example.

The shredder 12 cuts feedstock supplied by the supply unit 10 into shreds in a gas environment such as the atmosphere (air). The shreds in this example are pieces a few centimeters in size. In the example in the figure, the shredder 12 has shredder blades 14, and shreds the supplied feedstock by the shredder blades 14. In this example, a paper shredder is used as the shredder 12. The feedstock shredded by the shredder 12 is received into a hopper 1 and carried (conveyed) to the defibrating unit 20 through a conduit 2.

The defibrating unit 20 defibrates the feedstock shredded by the shredder 12. Defibrate as used here is a process of separating feedstock (material to be defibrated) comprising interlocked fibers into individual detangled fibers. The defibrating unit 20 also functions to separate particulate such as resin, ink, toner, and sizing agents in the feedstock from the fibers.

Material that has past through the defibrating unit 20 is referred to as defibrated material. In addition to untangled fibers, the defibrated material may also contain resin particles (resin used to bind multiple fibers together), coloring agents such as ink and toner, sizing agents, paper strengthening agents, and other additives that are separated from the fibers when the fibers are detangled. The shape of the detangled defibrated material is a string or ribbon. The detangled, defibrated material may be separated from (not interlocked with) other detangled fibers, or may be in lumps interlocked with other detangled defibrated material (in so-called fiber clumps).

The defibrating unit 20 defibrates in a dry process in ambient air (air). More specifically, an impeller mill is used as the defibrating unit 20. The defibrating unit 20 can also create an air flow that sucks in the feedstock and then discharges the defibrated material. As a result, the defibrating unit 20 can suction the feedstock with the air flow from the inlet 22, defibrate, and then convey the defibrated material to the exit 24 using the air flow produced by the defibrating unit 20. The defibrated material that past the defibrating unit 20 is conveyed through a conduit 3 to the classifier 30.

The classifier 30 classifies the defibrated material from the defibrating unit 20. More specifically, the classifier 30 separates and removes relatively small or low density material (resin particles, coloring agents, additives, for example) from the defibrated material. This increases the percentage of relatively large or high density material in the defibrated material.

An air classifying mechanism is used as the classifier 30. An air classifier produces a helical air flow that classifies material by the difference in centrifugal force resulting from the size and density of the material being classified, and the cut point can be adjusted by adjusting the speed of the air flow and the centrifugal force. More specifically, a cyclone, elbow-jet or eddy classifier, for example, may be used as the classifier 30. A cyclone classifier as shown in the figure is particularly well suited as the classifier 30 because of its simple construction.

The classifier 30 has an inlet 31, a cylinder 32 connected to the inlet 31, an inverted conical section 33 located below the cylinder 32 and connected continuously to the cylinder 32, a bottom discharge port 34 disposed in the bottom center of the conical section 33, and a top discharge port 35 disposed in the top center of the cylinder 32.

In the classifier 30, the air flow carrying the defibrated material introduced from the inlet 31 changes to a circular air flow in the cylinder 32. As a result, centrifugal force is applied to defibrated material that is introduced thereto, and the classifier 30 separates the defibrated material into fibers (first classified material) that are larger and higher in density than the resin particles and ink particles in the defibrated material, and resin particles, coloring agents, and additives (second classified material) in the defibrated material that are smaller and have lower density than the fiber in the defibrated material. The first classified material is discharged from the bottom discharge port 34, and introduced through a conduit 4 to the separator 40. The second classified material is discharged from the top discharge port 35 through another conduit 5 into a receiver 36.

The separator 40 selects fibers by length from the first classified material (defibrated material defibrated by the defibrating unit 20) that past the classifier 30 and was introduced from the inlet 42. A sieve (sifter) is used as the separator 40. The separator 40 has mesh (filter, screen), and can separate the first classified material into fiber or particles that are smaller than the size of the openings in the mesh (that pass through the mesh, first selected material), and fiber, undefibrated shreds, and clumps that are larger than the openings in the mesh (that do not pass through the mesh, second selected material). For example, the first selected material is received in a hopper 6 and then conveyed through a conduit 7 to the mixing unit 50. The second selected material is returned from the exit 44 through another conduit 8 to the defibrating unit 20. More specifically, the separator 40 is a cylindrical sieve that can be rotated by a motor. The mesh of the separator 40 may be a metal screen, expanded metal made by expanding a metal sheet with slits formed therein, or punched metal having holes formed by a press in a metal sheet.

The first web forming unit 45 conveys the first selected material from the separator 40 to the mixing unit 50. The first web forming unit 45 includes, for example, a mesh belt 46, tension rollers 47, and a suction unit (suction mechanism) 48.

The suction unit 48 suctions the first selected material that past through the openings (mesh openings) in the separator 40 and was dispersed in air onto the mesh belt 46. The first selected material accumulates on the moving mesh belt 46, forming a web V. The basic configuration of the mesh belt 46, tension rollers 47, and suction unit 48 are the same as the mesh belt 72, tension rollers 74, and suction mechanism 76 of the second web forming unit 70 described below.

The web V is a soft, fluffy web containing a lot of air as a result of passing through the separator 40 and first web forming unit 45. The web V formed on the mesh belt 46 is fed into a conduit 7 and conveyed to the mixing unit 50.

The mixing unit 50 mixes an additive containing resin with the first selected material (the first selected material conveyed by the first web forming unit 45) that past the separator 40. The mixing unit 50 has an additive supply unit 52 that supplies additive, a conduit 54 for conveying the selected material and additive, and a blower 56. In the example in the figure, the additive is supplied from the additive supply unit 52 through a hopper 9 to a conduit 54. Conduit 54 communicates with conduit 7.

The mixing unit 50 uses the blower 56 to produce an air flow, and can convey while mixing the selected material and additives in the conduit 54. Note that the mechanism for mixing the first selected material and additive is not specifically limited, and may mix by means of blades turning at high speed, or may use rotation of the container like a V blender.

A screw feeder such as shown in FIG. 1, or a disc feeder not shown, for example, may be used as the additive supply unit 52. The additive supplied from the additive supply unit 52 contains resin for binding multiple fibers together. The multiple fibers are not bound when the resin is supplied. The resin melts and binds multiple fibers when passing the sheet forming unit 80.

The resin supplied from the additive supply unit 52 is a thermoplastic resin or thermoset resin, such as AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone. These resins may be used individually or in a desirable combination. The additive supplied from the additive supply unit 52 may be fibrous or powder.

Depending on the type of sheet being manufactured, the additive supplied from the additive supply unit 52 may also include a coloring agent for coloring the fiber, an anti-blocking agent to prevent fiber agglomeration, or a flame retardant for making the fiber difficult to burn, in addition to resin for binding fibers. The mixture (a mixture of first selected material and additive) that passes the mixing unit 50 is conveyed through a conduit 54 to the air-laying unit 60.

The mixture that past the mixing unit 50 is introduced from the inlet 62 to the air-laying unit 60, which detangles and disperses the tangled defibrated material (fiber) in a gas environment such as ambient air (air) while the mixture precipitates. When the resin in the additive supplied from the additive supply unit 52 is fibrous, the air-laying unit 60 also detangles interlocked resin fibers. As a result, the air-laying unit 60 can lay the mixture uniformly in the second web forming unit 70.

A cylindrical sieve that turns is used as the air-laying unit 60. The air-laying unit 60 has mesh, and causes fiber and particles smaller than the size of the mesh (that pass through the mesh) and contained in the mixture that past the mixing unit 50 to precipitate. The configuration of the air-laying unit 60 is the same as the configuration of the separator 40 in this example.

Note that the sieve of the air-laying unit 60 may be configured without functionality for selecting specific material. More specifically, the "sieve" used as the air-laying unit 60 means a device having mesh, and the air-laying unit 60 may cause all of the mixture introduced to the air-laying unit 60 to precipitate.

The second web forming unit 70 lays the precipitate that past through the air-laying unit 60 into a web W. The web forming unit 70 includes, for example, a mesh belt 72, tension rollers 74, and a suction mechanism 76.

The mesh belt 72 is moving while precipitate that has past through the holes (mesh) of the air-laying unit 60 accumulates thereon. The mesh belt 72 is tensioned by the tension rollers 74, and is configured so that air passes through but it is difficult for the precipitate to pass through. The mesh belt 72 moves when the tension rollers 74 turn. A web W is formed on the mesh belt 72 as a result of the mixture that past the air-laying unit 60 precipitating continuously while the mesh belt 72 moves continuously. The mesh belt 72 may be metal, plastic, cloth, or nonwoven cloth.

The suction mechanism 76 is disposed below the mesh belt 72 (on the opposite side as the air-laying unit 60). The suction mechanism 76 produces a downward flow of air (air flow directed from the air-laying unit 60 to the mesh belt 72). The mixture distributed in air by the air-laying unit 60 can be pulled onto the mesh belt 72 by the suction mechanism 76. As a result, the discharge rate from the air-laying unit 60 can be increased. A downward air flow can also be created in the descent path of the mixture, and interlocking of defibrated material and additive during descent can be prevented, by the suction mechanism 76.

A soft, fluffy web W containing much air is formed by material passing through the air-laying unit 60 and second web forming unit 70 (web forming process) as described above. The web W laid on the mesh belt 72 is then conveyed to the sheet forming unit 80.

Note that a moisture content adjustment unit 78 for adjusting the moisture content of the web W is disposed in the example shown in the figure. The moisture content adjustment unit 78 adds water or water vapor to the web W to adjust the ratio of water to the web W.

The sheet forming unit 80 applies heat and pressure to the web W laid on the mesh belt 72, forming a sheet S. By applying heat to the mixture of defibrated material and additive contained in the web W, the sheet forming unit 80 can bind fibers in the mixture together through the additive (resin).

A heat roller (heating roller), hot press molding machine, hot plate, hot air blower, infrared heater, or flash fuser, for example, may be used in the sheet forming unit 80. In the example shown in the figure, the sheet forming unit 80 has a first binding unit 82 and a second binding unit 84, and the binding units 82, 84 each have a pair of heat rollers 86. By configuring the binding units 82, 84 with heat rollers 86, a sheet S can be formed while continuously conveying the web W, unlike when the binding units 82, 84 are configured with a flat press (flat press machine). Note that the number of heat rollers 86 is not specifically limited.

The cutting unit 90 cuts the sheet S formed by the sheet forming unit 80. In the example in the figure, the cutting unit 90 has a first cutter 92 that cuts the sheet S crosswise to the conveyance direction of the sheet S, and a second cutter 94 that cuts the sheet S parallel to the conveyance direction. The second cutter 94 cuts the sheet S after passing through the first cutter 92, for example.

Cut sheets S of a specific size are formed by the process described above. The cut sheets S are then discharged to the discharge unit 96.

1.2. Fiber

Fiber is used as part of the feedstock in the sheet manufacturing apparatus 100 according to this embodiment. Examples of usable fiber includes natural fiber (animal fiber, plant fiber) and synthetic fiber (organic fiber, inorganic fiber, and blends of organic and inorganic fibers), but any type of fiber enabling hydrogen bonds to be formed between the fibers may be used. More specifically, fibers derived from cellulose, silk, wool, cotton, true hemp, kenaf, flax, ramie, jute, manila, sisal, evergreen trees, and deciduous trees may be contained in the defibrated material, the fibers may be used alone, mixed with other fibers, or refined or otherwise processed as regenerated fiber. The fiber may also be dried, or it may contain or be impregnated with water, organic solvent, or other liquid. Various types of surface processing may also be applied to the defibrated material (fiber).

The average diameter (when not round in section, the maximum length in the direction perpendicular to the length, or the diameter of a circle assuming a circle with the same area as the area in cross section (circle equivalent diameter)) of individual fibers contained in a sheet according to this embodiment is, on average, greater than or equal to 1 μm and less than or equal to 1000 μm.

The length of the fibers contained in the defibrated material contained in a sheet in this embodiment is not specifically limited, but the length of single independent fibers along the length of the fiber is preferably greater than or equal to 1 μm and less than or equal to 5 mm. Expressed as the length-weighted mean length, the average fiber length is preferably greater than or equal to 20 μm and less than or equal to 3600 μm. The fiber length may also have some variation (distribution).

"Fiber" as used herein may refer to a single fiber or an agglomeration of multiple fibers (such as cotton). The fiber may be fiber (defibrated material) acquired by defibrating and detangling material defibrated in the defibrating process. The feedstock to be defibrated includes pulp sheet, paper, recovered paper, tissue paper, kitchen paper, cleaning paper, filter paper, liquid absorption materials, sound absorption materials, cushioning materials, mats, cardboard, and other products comprising interlocked or bonded fibers. Herein, the feedstock to be defibrated may be sheets manufactured by the invention or any sheets that have been used (recovered sheets). Fibers (organic fiber, inorganic fiber, and blends of organic and inorganic fibers) of rayon, Lyocell, cupro, Vinylon, acrylic, nylon, aramid, polyester, polyethylene, polypropylene, polyurethane, polyimide, carbon, glass, or metal may also be contained in the feedstock.

1.3. Additives

Additives including resin are supplied from the additive supply unit 52 in the sheet manufacturing apparatus 100 according to this embodiment. More specifically, the additives supplied from the additive supply unit 52 include resin for binding fibers together. At the time the additive is added, the fibers are not bound together. The resin in the additive melts or softens when passing through the sheet forming unit 80, and binds fibers together.

In this embodiment of the invention, the additive supplied from the additive supply unit 52 may be a composite (particle) of which at least part of the surface of the resin particles is covered with inorganic fine particles. The composite particles may be used alone or mixed with another appropriate material. The additive may also contain nanofiber. An example of nanofiber is cellulose nanofiber. Cellulose nanofiber is microfibrillated plant fiber (cellulose fiber) with a thickness of several to several ten nanometers. When nanofiber is combined with the additive, water is introduced between fibers, and when evaporated (dried), the nanofiber can strengthen hydrogen bonds between the fibers of the defibrated feedstock.

In the sheet manufacturing apparatus 100 according to this embodiment, resin is supplied from the additive supply unit 52 and triboelectrically charged when passing through the mixing unit 50 and air-laying unit 60. The charged resin sticks to the fibers, is deposited with the fiber on the mesh belt 72, and adheres (electrostatically adheres) to the fibers when laid in the web W.

The resin (component of the resin particles) may be a natural resin or synthetic resin, and may be a thermoplastic resin or thermoset resin. In the paper manufacturing apparatus 100 according to this embodiment, the resin is preferably a solid at room temperature, and considering bonding the fibers by heat in the sheet forming unit 80, is preferably a thermoplastic resin.

Examples of natural resins include rosin, dammar, mastic, copal, amber, shellac, Dragon's blood, sandarac, and colophonium, which may be used individually or in appropriate mixtures, and may be appropriately denatured.

Examples of synthetic resins that are a thermoset resin include thermosetting resins such as phenol resin, epoxy resin, melamine resin, urea resin, unsaturated polyester resin, alkyd resin, polyurethane, and thermoset polyimide resin.

Examples of synthetic resins that are thermoplastic resin include AS resin, ABS resin, polypropylene, polyethylene, polyvinyl chloride, polystyrene, acrylic resin, polyester resin, polyethylene terephthalate, polyethylene ether, polyphenylene ether, polybutylene terephthalate, nylon, polyimide, polycarbonate, polyacetal, polyphenylene sulfide, and polyether ether ketone.

The resins may also be copolymerized or modified, examples of such resins including styrene-based resin, acrylic-based resin, styrene-acrylic copolymers, olefin-based resin, vinyl chloride-based resin, polyester-based resin, polyamide-based resin, polyurethane-based resin, polyvinyl alcohol-based resin, vinyl ether-based resin, N-vinyl-based resin, and styrene-butadiene-based resin.

A coloring agent for coloring the fiber, or a flame retardant for making the fiber difficult to burn, may be included with the resin. At least one of these may be easily combined with the resin by a melt and knead process.

Resin and additive are combined in the mixing unit 50 in this example, and the ratio therebetween can be desirably adjusted appropriately to the strength, application, and other aspects of the sheet S being made. If the manufactured sheet S is copy paper or other business paper, the ratio of resin to fiber is preferably greater than or equal to 5 wt % and less than or equal to 70 wt %, and further preferably greater than or equal to 5 wt % and less than or equal to 50 wt % considering the need for a good mixture in the mixing unit 50 and inhibiting separation of the resin by gravity and the air stream of the suction mechanism 76 when forming the mixture into a sheet.

1.4. Liquid Application Unit

Figure 2:
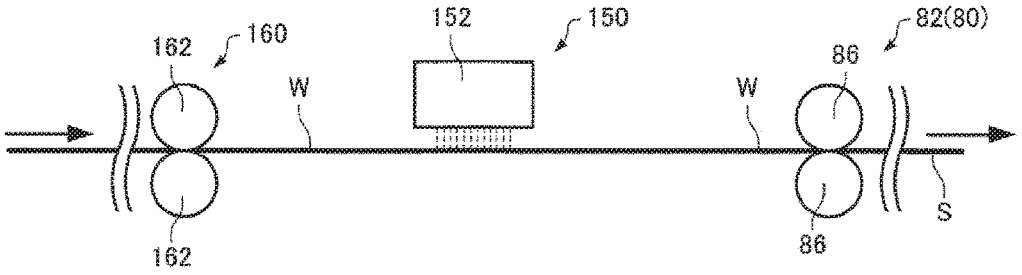
FIG. 2 is an enlarged view of part of the area indicated by the imaginary line A in FIG. 1.
Figure 3:
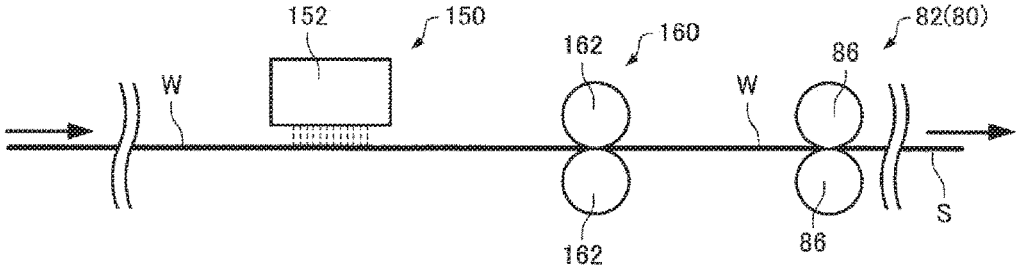
FIG. 3 is an enlarged view of part of the area indicated by the imaginary line A in FIG. 1.

The sheet manufacturing apparatus 100 according to this embodiment has a liquid application unit 150. FIG. 2 and FIG. 3 correspond to the portion surrounded by the dotted line indicated by A in FIG. 1, and show a configuration including a pressuring unit 160, the liquid application unit 150, and part of the sheet forming unit 80.

The liquid application unit 150 is disposed in the sheet manufacturing apparatus 100 on the downstream side of the configuration (air-laying unit 60) where the web W is formed. The liquid application unit 150 is also disposed on the upstream side of the configuration (sheet forming unit 80) where the web W is heated and the sheet S is formed. In the sheet manufacturing apparatus 100 according to this embodiment, the liquid application unit 150 is also disposed upstream from the first binding unit 82 (sheet forming unit) of the sheet forming unit 80.

The liquid application unit 150 adds water to part of the precipitate (web W) deposited by the air-laying unit 60. The liquid application unit 150 does not add water to all of the deposited precipitate, and in this respect differs from the moisture content adjustment unit 78 described above that adjusts the moisture content of the web W. The liquid application unit 150 adds water, and the volume and diameter of the water droplets added by the liquid application unit 150 differ from the water added by the moisture content adjustment unit 78. More specifically, the weight of the water per unit area of the web W that is applied to the web W by the liquid application unit 150 is several times to several ten times the weight per unit area of the web W of the water applied as mist by the moisture content adjustment unit 78.

The amount of water applied to the web W by the liquid application unit 150 is set appropriately with consideration for the type and amount of fiber and resin in the web W, the amount of heat applied by the heat of water vaporization and the heat applied by the heat unit (sheet forming unit 80), and the mechanical strength of the area of the sheet S where the moisture is added.

The liquid application unit 150 in this example is embodied by a recording head 152 of an inkjet-recording type. The recording head 152 is depicted in FIG. 2 and FIG. 3. The recording head 152 may be a line head or a serial head. If the recording head 152 is a line head, a configuration for moving the recording head 152 is not needed, and device size can be reduced.

The recording method of the recording head 152 is not specifically limited insofar as water can be ejected as droplets from the nozzles of the recording head 152 so that the droplets land on the web W. For example, the recording head 152 may use electrostatic suction, discharge fluid droplets by pump pressure, use a piezoelectric device, or use a bubble jet method of heating the fluid with an electrode to produce and eject droplets. In addition to the recording head 152, the liquid application unit 150 may also include a case, a carriage mechanism for the recording head 152, various drivers, controllers, sensors, trays, operating panel, and other configurations as appropriate.

By configuring the liquid application unit 150 with an on-demand recording head 152, a desirable amount of water can be applied with extreme accuracy to a desired location on the web W. The liquid application unit 150 may also be configured with a dispenser, not shown, instead of a recording head 152. The liquid application unit 150 is preferably configured to enable applying moisture in a freely designed pattern, such as enabled by a recording head 152 or dispenser. Because the liquid application unit 150 is configured with a recording head 152 in the sheet manufacturing apparatus 100 according to this embodiment, water can be applied to the web W with excellent positioning precision.

The moisture applied to the web W by the liquid application unit 150 may be water, an aqueous solution, or a dispersion with a water medium. In other words, the water is preferably water, an aqueous solution, or an aqueous dispersion. The aqueous dispersion further preferably is a dispersion of cellulose nanofiber. Hydrogen bonds between fibers in the web W can be strengthened by applying cellulose nanofiber with water to the web W. The water may be pure water or ultrapure water such as deionized water, ultrafiltered water, reverse osmosis water, or distilled water. Water that has been sterilized by UV radiation or adding hydrogen peroxide to any of these types of water is particularly preferable because the growth of algae and bacteria can be suppressed for a long time.

The liquid application unit 150 in the sheet manufacturing apparatus 100 according to this embodiment is configured so that the recording head 152 applies moisture from only one side of the web W. However, while not shown in the figures, recording heads 152 may be disposed to impart moisture to both sides of the web W. The liquid application unit 150 may also include multiple recording heads 152, is not limited to using a recording head 152, and may be desirably configured in other ways (such as with a fluid nozzle).

1.5. Pressuring Unit

As shown in FIG. 2 and FIG. 3, the sheet manufacturing apparatus 100 according to this embodiment has a pressuring unit 160. The pressuring unit 160 is disposed in the sheet manufacturing apparatus 100 on the downstream side of the configuration (air-laying unit 60) where the web W is formed. The pressuring unit 160 is disposed upstream from the configuration (sheet forming unit 80) where the web W is heated and becomes a sheet S. In the sheet manufacturing apparatus 100 shown in FIG. 2, the pressuring unit 160 is downstream from the air-laying unit 60 and upstream from the liquid application unit 150. Note that, as shown in FIG. 3, the pressuring unit 160 may alternatively be downstream from the liquid application unit 150 and upstream from the heat unit (first binding unit 82).

The pressuring unit 160 is a pair of pressuring unit rollers 162, and applies pressure to the web W. The pressure applied to the web W reduces the thickness of the web W and increases the density of the web W. The pressuring unit 160 can apply greater pressure to the web W than the pressure applied to the web W by the first binding unit 82 (sheet forming unit 80).

The pressuring unit 160 is not an essential configuration, but by disposing the pressuring unit 160 upstream from the liquid application unit 150, the density of the web W can be increased and the space between fibers reduced. As a result, water applied by the liquid application unit 150 can be suppressed from bleeding (the wetness spreading) across the plane of the web W. This inhibits the spread of moisture applied by the liquid application unit 150, can form a moistened area 154 with sharper edges, and can increase the contrast of the watermark that is formed.

1.6. Effect of Applying Moisture

When applied to the web W, the moisture wets the fiber and resin in the web W. When the part of the web W to which moisture was applied is heated and compressed in the heat unit (sheet forming unit 80), the water evaporates and induces hydrogen bonds between the fibers. As a result, the part of the web W to which moisture was applied is made more dense than where moisture is not applied.

The web W is heated and compressed in the sheet forming unit 80, binding the fiber and resin. The sheet forming unit 80 softens and binds the resin with the fiber, and evaporates the water applied by the liquid application unit 150. Evaporation of the water induces hydrogen bonds between the fibers. While bonds between fibers are created by the resin in the sheet forming unit 80, the fibers have elasticity, and the thickness of the sheet S is increased by the elasticity of the fibers when the pressure is removed after passing through the sheet forming unit 80. Because hydrogen bonds are formed in addition to the resin bonds in the area where moisture was added, recovery of the thickness of the sheet S is less than in the areas where moisture was not added. More specifically, the density of the sheet S in the area where moisture was added is greater than where moisture was not added. In other words, there are fewer spaces in the sheet S where water was added than where water was not added.

When a sheet S is formed by passing the web W through the heating/compression unit (sheet forming unit 80) after adding water to part of the web W, areas with relatively high density, and areas with relatively low density, can be formed in the sheet S. The sheet manufacturing apparatus 100 according to this embodiment can make a sheet S having high density parts.

Note that herein parts (areas) of the sheet S with relatively high density are referred to as high density parts (areas), and parts (areas) of the sheet S with relatively low density are referred to as low density parts (areas).

The high density parts (areas) of the sheet S have fewer spaces, and/or the size of the spaces is small. As a result, there is less scattering of light in the high density parts (areas) than in the low density parts (areas). Light transmittance is greater, and reflectance of light is lower, in the high density parts than in relatively low density parts. As a result, watermarks can be formed in the sheet S by the high density parts (parts were water was added) and the low density parts.

Figure 4:
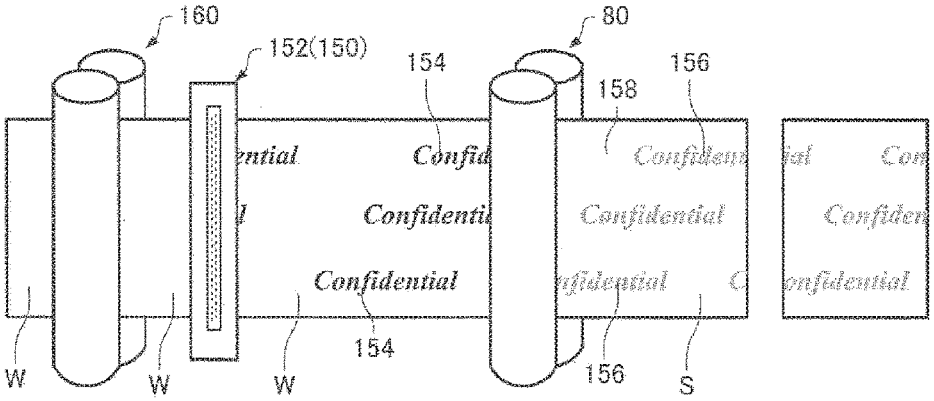
FIG. 4 illustrates an example of making a sheet using the sheet manufacturing apparatus according to this embodiment.

FIG. 4 illustrates an example of a sheet S manufactured by the sheet manufacturing apparatus 100 according to this embodiment. FIG. 4 illustrates forming a sheet S by the liquid application unit 150 adding water to the web W to create a moistened area 154, and then passing the web W through the sheet forming unit 80 (heating/compressing unit), thereby producing high density parts 156 at the positions corresponding to the moistened areas 154 of the web W, and then cutting the sheet S with the cutting unit 90.

As shown in FIG. 4, the area to which water is added becomes a high density part 156 in the resulting sheet S, and increases light transmittance. As a result, high density parts 156 and low density parts 158 can be formed in the sheet S, and watermarks can be made. Such watermarks can be made easily by the sheet manufacturing apparatus 100 according to this embodiment when making the sheet S. The sheet manufacturing apparatus 100 according to this embodiment also enables freely changing, when desired, the parts to which water is applied by the liquid application unit 150 (recording head 152) using an inkjet method. Watermarks of any desired design can therefore be made in the sheet S, and the watermark design can be easily changed.

1.7. Other Embodiments

Figure 5:
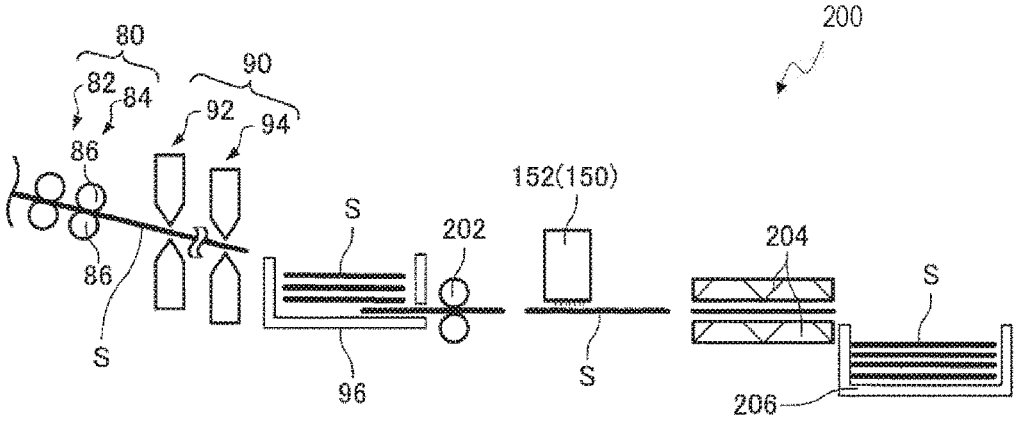
FIG. 5 illustrates the configuration of a sheet manufacturing apparatus according to a variation of this embodiment.

FIG. 5 illustrates part of a sheet manufacturing apparatus 200 according to another embodiment of the invention. A sheet manufacturing apparatus according to this embodiment has a defibrating unit that defibrates, in air, feedstock including fiber; a mixing unit that mixes, in air, resin with the defibrated feedstock that was defibrated by the defibrating unit; an air-laying unit that lays the mixture output by the mixing unit; a sheet forming unit that forms a first sheet by heating the precipitate laid by the air-laying unit; a liquid application unit that adds water by an inkjet method, for example, to part of the first sheet; and a heating/compression unit that heats and compresses the first sheet to which water was applied by the liquid application unit, forming a second sheet having parts with different light transmittance.

Like the sheet manufacturing apparatus 100 according to the embodiment described above, the sheet manufacturing apparatus 200 according to this embodiment has a supply unit, manufacturing unit, and control unit, the manufacturing unit including a shredder 12, defibrating unit 20, classifier 30, separator 40, first web forming unit 45, mixing unit 50, air-laying unit 60, second web forming unit 70, sheet forming unit 80, cutting unit 90, and discharge unit 96. The configuration of a sheet manufacturing apparatus 200 according to this embodiment is basically the same as the sheet manufacturing apparatus 100 described above, like parts in this and the first embodiment are identified by like reference numerals, and further description thereof is omitted below. The configuration upstream from the sheet forming unit 80 is omitted in FIG. 5.

In this sheet manufacturing apparatus 200, a single sheet S received in the discharge unit 96 after passing the sheet forming unit 80 (heat unit) and cutting unit 90 is conveyed by conveyance rollers 202, and water is then added to part of the sheet S by the recording head 152 (liquid application unit 150). After water is added, the sheet S is heated and compressed by a hot press 204 (heating/compression unit), thereby forming a high density part 156 in the sheet S (sheet S').

Figure 6:
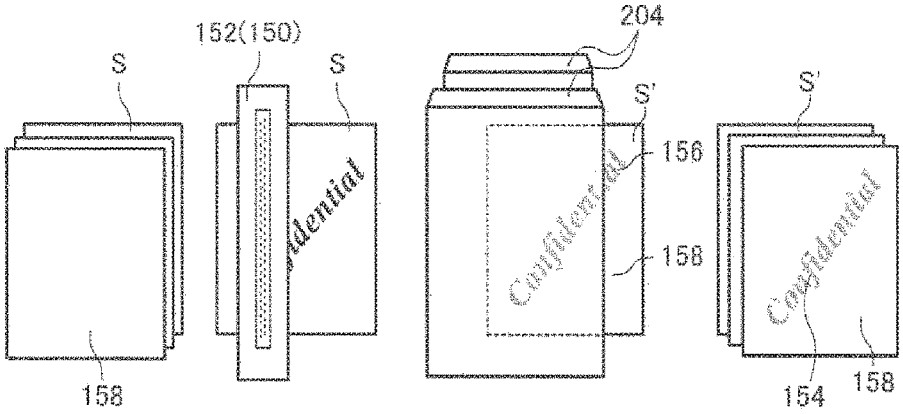
FIG. 6 illustrates an example of making a sheet using the sheet manufacturing apparatus according to this variation of the invention.

FIG. 6 illustrates a sheet S manufactured by the sheet manufacturing apparatus 200 according to this embodiment. FIG. 6 illustrates forming, by the liquid application unit 150 adding water to the sheet S (first sheet) to form a moistened area 154, and then heating and compressing the first sheet in the heating/compression unit (hot press 204), a high density part 156 in the part of the sheet S' (second sheet) corresponding to the moistened area 154.

As shown in FIG. 6, the moistened area 154 where water was added by the liquid application unit 150 (recording head 152) becomes the high density parts 156 in the resulting sheet S' (second sheet), and increases the transmittance of light. As a result, high density parts 156 and low density parts 158 can be formed in the sheet S' (second sheet), and a watermark can be made. The sheet manufacturing apparatus 200 according to this embodiment enables freely changing the part where the liquid application unit 150 (recording head 152) adds water by the inkjet method. Watermarks of any desired design can therefore be made in the sheet S (first sheet), and the design of the watermark can be easily changed.

The sheet S (first sheet) to which water is imparted by the sheet manufacturing apparatus 200 according to this embodiment may be a sheet with uniform density, or a sheet in which a high density part 156 has already been formed. In other words, the sheet manufacturing apparatus 200 according to this embodiment can form high density parts 156 by adding water to low density parts 158. As a result, the liquid application unit 150 need not be located upstream of the sheet forming unit 80 in the sheet manufacturing apparatus 200 according to this embodiment. The configuration of the sheet manufacturing apparatus 200 according to this embodiment upstream from the sheet forming unit 80 can also be the same as in the sheet manufacturing apparatus 100 in the embodiment described above, and two sets of liquid application unit 150 and heating/compression units may be used.

2. Sheet Manufacturing Method

The sheet manufacturing method of the invention includes a defibrating process, mixing process, laying process, liquid application process, and sheet forming process. More specifically, the defibrating process defibrates feedstock containing fiber in air; the mixing process mixes, in air, the defibrated feedstock from the defibrating process with resin; the laying process lays the mixture from the mixing process into a web; the liquid application process adds water, by an inkjet method, for example, to part of the precipitate laid in the laying process; and the sheet forming process heats and compresses the web to which water was added in the liquid application process, forming a sheet with areas of different light transmittance.

The sheet manufacturing method of the invention can be used by the sheet manufacturing apparatus 100 described above, for example. The defibrating process can be done by the defibrating unit 20 described above. The mixing process can be done by the mixing unit 50 described above. The laying process can be done by the air-laying unit 60 described above. The liquid application process can be done by the liquid application unit 150 described above. The sheet forming process can be done by the sheet forming unit 80 (heating/compression unit) described above. The fiber and resin used in the sheet manufacturing method of the invention are the same as described in sheet manufacturing apparatus described above, and further description thereof is omitted.

The sheet manufacturing method of the invention can reduce the scattering of light in the high density parts 156 of the sheet S corresponding to the moistened area 154 of the web W. As a result, the transmittance of light and/or the reflection of light can be made different in the high density parts 156 and low density parts 158, and sheets S with a watermark can be easily manufactured.

The sheet manufacturing method in another embodiment of the invention includes a defibrating process, mixing process, laying process, sheet forming process, liquid application process, and heating/compression process. More specifically, the defibrating process defibrates feedstock containing fiber in air; the mixing process mixes, in air, the defibrated feedstock from the defibrating process with resin; the laying process lays the mixture from the mixing process into a web; the sheet forming process heats the web laid in the laying process, forming a first sheet; the liquid application process adds water, by an inkjet method, for example, to part of the first sheet; and the heating/compression process heats and compresses the first sheet to which water was added in the liquid application process, forming a second sheet with areas of different light transmittance.

The sheet manufacturing method in this embodiment of the invention can be used by the sheet manufacturing apparatus 200 described above, for example. The defibrating process can be done by the defibrating unit 20 described above. The mixing process can be done by the mixing unit 50 described above. The laying process can be done by the air-laying unit 60 described above. The sheet forming process can be done by the sheet forming unit 80 described above. The liquid application process can be done by the liquid application unit 150 described above. The heating/compression process can be done by the sheet forming unit 80 described above and hot press 204 (heating/compression unit).

The sheet manufacturing method in this embodiment of the invention can reduce the scattering of light in the high density parts 156 of the second sheet corresponding to the moistened area 154 of the first sheet. As a result, the transmittance of light and/or the reflection of light can be made different in the high density parts 156 and low density parts 158, and second sheets S with a watermark can be easily manufactured.

3. Sheets

Sheets manufactured by the sheet manufacturing apparatus or the sheet manufacturing method of the invention have, as described above, high density parts and low density parts. The sheets can have detailed watermarks formed by imparting water by an inkjet method, for example.

The sheets are made from at least fiber and resin as described above, and may be in the form of a sheet, board, web, or textured shapes. Sheets as used herein include paper and nonwoven cloth. Paper includes products manufactured as sheets from pulp or recovered paper as the feedstock, and includes recording paper for handwriting or printing, wall paper, wrapping paper, construction paper, drawing paper, and bristol. Nonwoven cloth may be thicker and weaker than paper, and includes common nonwoven cloth, fiber board, tissue paper (tissue paper for cleaning), kitchen paper, vacuum filter bags, filters, fluid (waste ink, oil) absorbers, sound absorbers, cushioning materials, and mats. The spaces between fibers are large (sheet density is low) in nonwoven cloth. In paper, the spaces between fibers are small (sheet density is high). The feedstock may include cellulose and other plant fiber, PET (polyethylene terephthalate), polyester, and other types synthetic fiber, wool, silk, and other types of animal fiber.

4. Additional Notes

"Uniform" as used herein means, in the case of a uniform dispersion or mixture, that the relative positions of one component to another component in an object that can be defined by components of two or more types or two or more phases are the same throughout the whole system, or identical or effectively equal in each part of a system. Uniformity of coloring or tone means there is no gradation in color and color density is the same when looking at the paper in plan view.

Words meaning uniform, same, equidistant and similar terms meaning that density, distance, dimensions, and similar terms are equal are used herein. These are preferably equal, but include values deviating without being equal by the accumulation of error, deviation, and such because complete equality is difficult.

The invention may be configured to omit some of the configurations described above insofar as the features and effects described above are retained, and may combine aspects of different embodiments and examples.

The present invention is not limited to the embodiment described above, and can be varied in many ways. For example, the invention includes configurations (configurations of the same function, method, and effect, or configurations of the same objective and effect) that are effectively the same as configurations described in the foregoing embodiment. The invention also includes configurations that replace parts that are not essential to the configuration described in the foregoing embodiment. Furthermore, the invention includes configurations having the same operating effect, or configurations that can achieve the same objective, as configurations described in the foregoing embodiment. Furthermore, the invention includes configurations that add technology known from the literature to configurations described in the foregoing embodiment.

The entire disclosure of Japanese Patent Application No: 2015-77462, filed Apr. 6, 2015 is expressly incorporated by reference herein.

REFERENCE SIGNS LIST

1 hopper
2 conduit
3, 4, 5 conduit
6 hopper
7, 8 conduit
9 hopper
10 supply unit
12 shredder
14 shredder blades
20 defibrating unit
22 inlet
24 exit
30 classifier
31 inlet
32 cylinder
33 conical section
34 bottom discharge port
35 top discharge port
36 receiver
40 separator
42 inlet
44 exit
45 first web forming unit
46 mesh belt
47 tension rollers
48 suction unit
50 mixing unit
52 additive supply unit
54 conduit
56 blower
60 air-laying unit
62 inlet
70 second web forming unit
72 mesh belt
74 tension rollers
76 suction mechanism
78 moisture content adjustment unit
80 sheet forming unit
82 first binding unit
84 second binding unit
86 heat rollers
90 cutting unit
92 first cutting unit
94 second cutting unit
96 discharge unit
100 sheet manufacturing apparatus
102 manufacturing unit
140 control unit
150 liquid application unit
152 recording head
154 moistened area
156 high density parts
158 low density parts
160 pressuring unit
162 calender rollers
200 sheet manufacturing apparatus
202 conveyance rollers
204 hot press
206 tray V web
W web
S sheet

The invention claimed is:

1. A sheet manufacturing apparatus comprising:

a defibrating unit configured to defibrate, in air, feedstock containing fiber;

a mixing unit configured to mix, in air, resin with the fiber defibrated from the feedstock by the defibrating unit;

an air-laying unit configured to lay a web from the mixture output from the mixing unit;

a liquid application unit configured to add water to part of the web laid by the air-laying unit; and a sheet forming unit configured to form a sheet with parts having different light transmittance by heating and compressing the web to which water was added by the liquid application unit.

2. The sheet manufacturing apparatus described in claim 1, further comprising:

a pressuring unit that compresses the web;

the liquid application unit adding the water to the web after compression by the pressuring unit.

3. The sheet manufacturing apparatus described in claim 1, wherein:

the liquid application unit imparts water by an inkjet method.

4. The sheet manufacturing apparatus described in claim 1, wherein:

the liquid application unit imparts water containing nanofiber.

5. A sheet manufacturing apparatus comprising:

a defibrating unit configured to defibrate, in air, feedstock containing fiber;

a mixing unit configured to mix, in air, resin with the fiber defibrated from the feedstock by the defibrating unit;

an air-laying unit configured to lay a web from the mixture output from the mixing unit;

a sheet forming unit configured to form a first sheet by heating the web laid by the air-laying unit;

a cutting unit configured to cut the first sheet;

a discharge unit configured to receive the first sheet that has been cut at the cutting unit;

conveyance rollers configured to convey the first sheet from the discharge unit; and a liquid application unit configured to add water to part of the first sheet that has been conveyed from the discharge unit by the conveyance rollers; and a heating/compression unit configured to heat and compress the first sheet to which water was imparted by the liquid application unit, forming a second sheet with parts having different light transmittance.

6. A sheet manufacturing method, comprising:

a defibrating step of defibrating, in air, feedstock containing fiber;

a mixing step of mixing, in air, resin with the fiber defibrated from the feedstock in the defibrating step;

an air-laying step of laying a web from the mixture output by the mixing step;

a liquid application step of adding water to part of the web laid in the air-laying step; and a sheet forming step of forming a sheet with parts having parts with different light transmittance by heating and compressing the web to which water was added in the liquid application step.

7. A sheet manufacturing method, comprising:

defibrating, in air, feedstock containing fiber;

mixing, in air, resin with the fiber defibrated from the feedstock in the defibrating;

air-laying a web from the mixture output by the mixing;

forming a first sheet by heating the web laid in the air-laying;

cutting the first sheet;

receiving in a discharge unit the first sheet that has been cut;

conveying, by conveyance rollers, the first sheet from the discharge unit;

adding water to part of the first sheet that has been conveyed from the discharge unit by the conveyance rollers; and heating and compressing the first sheet to which water was imparted in the adding, forming a second sheet having parts with different light transmittance.

* * * * *